US007017355B2

(12) United States Patent
Allison et al.

(10) Patent No.: US 7,017,355 B2
(45) Date of Patent: Mar. 28, 2006

(54) ICE MACHINE EVAPORATOR ASSEMBLIES WITH IMPROVED HEAT TRANSFER AND METHOD FOR MAKING SAME

(75) Inventors: Matthew Allison, Mundelein, IL (US); Casimer S. Sowa, Racine, WI (US)

(73) Assignee: Scotsman Ice Systems, Vernon Hills, IL (US)

( * ) Notice: Subject to any disclaimer, the term of this patent is extended or adjusted under 35 U.S.C. 154(b) by 115 days.

(21) Appl. No.: 10/795,134

(22) Filed: Mar. 5, 2004

(65) Prior Publication Data

US 2004/0187513 A1 Sep. 30, 2004

Related U.S. Application Data

(60) Provisional application No. 60/527,956, filed on Dec. 9, 2003, provisional application No. 60/479,646, filed on Jun. 19, 2003, and provisional application No. 60/453,096, filed on Mar. 7, 2003.

(51) Int. Cl.
*F25C 1/12* (2006.01)

(52) U.S. Cl. ..... 62/74; 62/374; 62/515

(58) Field of Classification Search ..... 62/347, 62/352, 515, 73, 74
See application file for complete search history.

(56) References Cited

U.S. PATENT DOCUMENTS

| | | | | | |
|---|---|---|---|---|---|
| 2,626,130 | A | * | 1/1953 | Raskin | 165/170 |
| 3,423,952 | A | * | 1/1969 | Pugh | 62/138 |
| 3,430,452 | A | * | 3/1969 | Dedricks et al. | 62/138 |
| 3,827,485 | A | * | 8/1974 | Hickman et al. | 165/171 |
| 4,344,298 | A | * | 8/1982 | Biemiller | 62/347 |
| 4,379,390 | A | * | 4/1983 | Bottum | 62/354 |
| 4,823,559 | A | * | 4/1989 | Hagen | 62/347 |
| 4,986,088 | A | * | 1/1991 | Nelson | 62/347 |
| 5,193,357 | A | * | 3/1993 | Kohl et al. | 62/347 |
| 6,311,501 | B1 | * | 11/2001 | Allison et al. | 62/74 |

* cited by examiner

*Primary Examiner*—William E. Tapolcai
(74) *Attorney, Agent, or Firm*—Ohlandt, Greeley, Ruggiero & Perle, L.L.P.

(57) ABSTRACT

An evaporator assembly and method of making the assembly wherein a refrigerant flow path is created that covers a large area of the back of either one or two evaporator pans. The refrigerant conduit includes a plurality of elongated sections that are non-circular, for example, rectangular, in cross-section. The sections are sized and spaced so as that refrigerant flow therethrough covers substantially all of the backs of the evaporator pans. The sections are formed with either tubes or ridges. The evaporator assembly is made by using bonding processes and/or die casting processes.

31 Claims, 6 Drawing Sheets

ICE MACHINE EVAPORATOR ASSEMBLIES WITH IMPROVED HEAT TRANSFER AND METHOD FOR MAKING SAME

CROSS-REFERENCE TO RELATED APPLICATIONS

This application claims priority of U.S. Provisional Application No. 60/453,096 filed Mar. 7, 2003, U.S. Provisional Application No. 60/479,646 filed Jun. 19, 2003 and U.S. Provisional Application No. 60/527,956 filed Dec. 9, 2003, and the entire contents of each is incorporated herein by reference.

FIELD OF THE INVENTION

This invention relates to ice machine evaporator assemblies with improved heat transfer and methods of making the assemblies.

BACKGROUND OF THE INVENTION

Ice machines include an evaporator assembly that includes a refrigerant conduit and an evaporator pan. The evaporator pan has a front side upon which ice cubes are formed and a back side that is in thermal transfer relation to the refrigerant conduit. The refrigerant conduit is constructed of copper tube formed into a serpentine shape. The copper tube sections are circular in cross-section, which provides a non-uniform refrigerant flow spacing from the back of the evaporator pan, thereby resulting in a non-uniform heat transfer across the diameter of the copper tube. Moreover, adjacent tube sections are spaced so much from one another that the refrigerant flow covers a relatively small area of the back of the evaporator pan, which typically is about 25% or less.

The ice assemblies are generally formed by soldering the copper tube serpentine to the back of the evaporator pan opposite the side of the ice forming structures. Each solder area is an area of structural weakness that can fracture during operation. Also, the multiple solder areas increase the cost and time of assembly.

There is a need for an evaporator assembly with an improved heat transfer and for a method of making the evaporator assembly.

The present invention allows for two evaporator pans and ice grids per serpentine. This increased refrigerant contact area and quantity of evaporator pans and ice grids lead to the following advantages:

1) Allows the ice machine to run at a higher evaporator temperature for a given ice capacity resulting in a 30% reduction in energy consumption.
2) The increased evaporator efficiency results in the ability to substantially reduce compressor size, resulting in lower costs and less noise.
3) For a given ice making capacity, evaporator internal volume is reduced by 65%, resulting in lower refrigerant costs and less compressor floodback during harvest.
4) For a given ice making capacity, evaporator weight is reduced by 65%. This reduces the amount of capacity and energy required to cool and heat the evaporator for the freeze and harvest cycles. This also reduces evaporator costs as less material is required.
5) The increased evaporator efficiency allows for a smaller evaporator for a given ice capacity resulting in smaller overall machine size.

6) Existing copper designs require a nickel plating to be compliant with National Sanitation Foundation (NSF) requirements. Stainless steel has no such plating requirement resulting in substantially lower evaporator costs.
7) Evaporator assembly 120 allows nearly 100% of evaporator pans 122 and 124 to be in direct contact with the refrigerant. Existing copper tube designs have 0% of the evaporator pans in direct contact with the refrigerant. Existing copper tube designs use a soldering process to attach a copper tube to a copper evaporator pan. The copper tube typically covers only 25% of the evaporator pan. Also, copper tube designs and manufacturing processes allow for only one evaporator pan and ice grid per serpentine.

SUMMARY OF THE INVENTION

An evaporator assembly of the present invention includes at least one evaporator pan including a first side with a structure that facilitates formation of ice cubes and a second side. A refrigerant conduit is disposed in thermal contact with the second side of the evaporator pan. The refrigerant conduit comprises one or more sections sized such that refrigerant flows through the sections and covers a percentage of the second side of the evaporator pan that is in a range selected from the group consisting of: about 30% to 100%, about 40% to 100% and about 80% to 100%.

In some embodiments, refrigerant flow through the sections covers substantially all of the second side of the evaporator pan.

In some embodiments, one or more of the refrigerant conduit sections have a non-circular cross-section. In one version, the cross-section has a side that is substantially flat and that is substantially parallel to the first side. Preferably, the cross-section is rectangular.

In one embodiment, the refrigerant conduit further comprises first and second headers that connect the sections in a pattern. Preferably, the pattern is serpentine. Also, preferably, each of the sections comprises a rectangular tube that has one surface that is mounted in direct mechanical contact with the second side of the evaporator pan.

In other embodiments, a ridge structure defines the refrigerant conduit sections. Preferably, the ridge structure comprises a plurality of ridges that are integral with the second side of the evaporator pan. At least two of the ridges are spaced from and parallel to one another so as to form opposed sides of at least one of the sections. The area between the two ridges forms another side of the section. Preferably, at least one of the ridges is shared with an adjacent section. In some of these embodiments, first and second fittings are arranged with the plurality of ridges to provide a serpentine pattern.

In any of the aforementioned embodiments, there is provided an additional evaporator pan having a first side with a structure that facilitates formation of ice cubes and a second side. The refrigerant conduit is also in thermal contact with the second side of the additional evaporator pan. In some of these embodiments, the non-circular cross-section has opposed sides that are substantially flat and substantially parallel to the first sides of the evaporator pan and the additional evaporator pan.

The method of the present invention makes an evaporator assembly by forming an ice cube structure on a first side of at least one evaporator pan. A refrigerant conduit is formed on a second side of the evaporator pan. The refrigerant conduit comprises one or more sections that are sized such that refrigerant flow through the sections covers a percentage of the second side of the evaporator pan that is in a range of about 30% to 100%, preferably about 40% to 100% and most preferably about 80% to 100%.

In a first specific embodiment of the method, the conduit sections are individual parts that are formed on the second side of the evaporator pan by a bonding process.

In one version of the first embodiment, each of the conduit section parts comprises an elongated rectangular tube. The bonding process bonds a surface of each of the elongated rectangular tubes to the second side of the evaporator pan. Preferably, the elongated rectangular tubes are arranged parallel to one another on the second side of the evaporator pan. First and second headers are disposed at opposite ends of the elongated rectangular tubes. The bonding process bonds the first and second headers to the elongated rectangular tubes.

In a second specific embodiment of the method, the refrigerant conduit comprises a ridge structure that defines the sections. Preferably, first and second fittings are connected to the ridge structure so as to form a serpentine refrigerant flow path.

In one version of the second embodiment of the method, the ridge structure is formed on the second side of the evaporator pan by a bonding process. Preferably, the ridge structure is disposed between the second side of the evaporator pan and a body that includes a substantially flat surface that is substantially parallel to the second side of the evaporator pan. The bonding process bonds the ridge structure to the flat surface.

In another version of the second embodiment of the method, the ridge structure is formed on the second side of the evaporator pan by a die cast process. Preferably, the ridge structure is closed by an adjacent body that is shaped to give each of the sections a substantially rectangular cross-section. In a particular design of this version, the body comprises a mating ridge structure on a surface thereof. The ridge structures are fastened together in a mating way to form the sections.

In any of the aforementioned embodiments of the method, the refrigerant conduit is also fastened to a second side of an additional evaporator pan. In some of these embodiments, the refrigerant flow through the sections covers substantially all of the second sides of the evaporator pan and the additional evaporator pan.

In the aforementioned embodiments that use a bonding process, the bonding process may use a brazing material.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENTS

Figure 2:
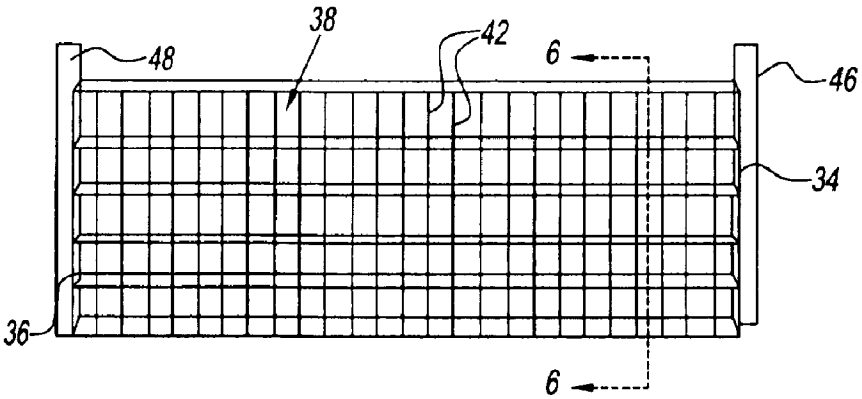
FIG. 2 is a front view of FIG. 1.
Figure 3:
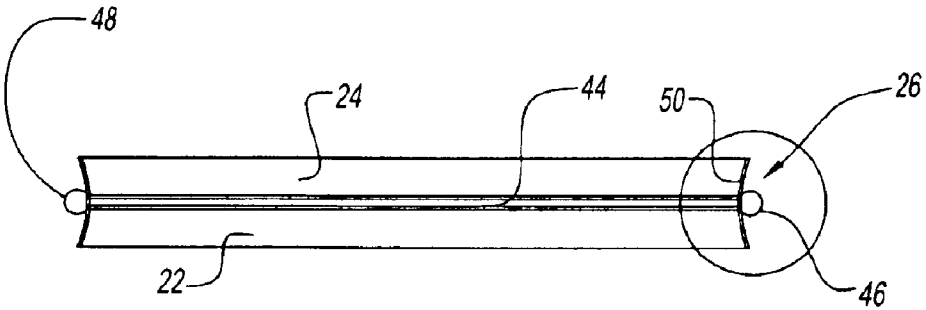
FIG. 3 is a top view of FIG. 1.
Figure 1:
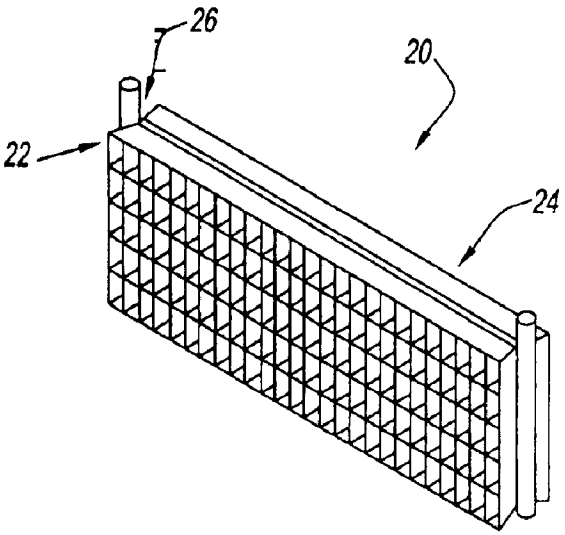
FIG. 1 is a perspective view of the evaporator pan and refrigerant assembly of the present invention.

Referring to FIG. 1, an evaporator assembly 20 of the present invention includes a first evaporator pan 22, a second evaporator pan 24 and a refrigerant conduit 26 disposed between evaporator pans 22 and 24.

Referring to FIGS. 2–6, each of the evaporator pans 22 and 24 are substantially identical so that only evaporator pan 22 will be described in detail. Evaporator pan 22 includes a bottom 27, a top side 32 and opposed sides 34 and 36. Bottom 27 includes a front 28 and a back 30. An ice cube structure shown as an ice grid 38 is disposed on front 28 and between opposed sides 34 and 36 of evaporator pan 22. Ice grid 38 has a plurality rows, each formed of a fin 40, and a plurality of columns, each formed of a divider 42.

Fins 40 are disposed at a slight angle to front 28 in order to assist in the ice harvesting process. The bottom most fin 40 serves as the bottom side of evaporator pan 22. It will be apparent to those skilled in the art that the ice cube structure can be formed of other structures and that the ice cubes formed thereby can have any suitable geometry.

Figure 6:
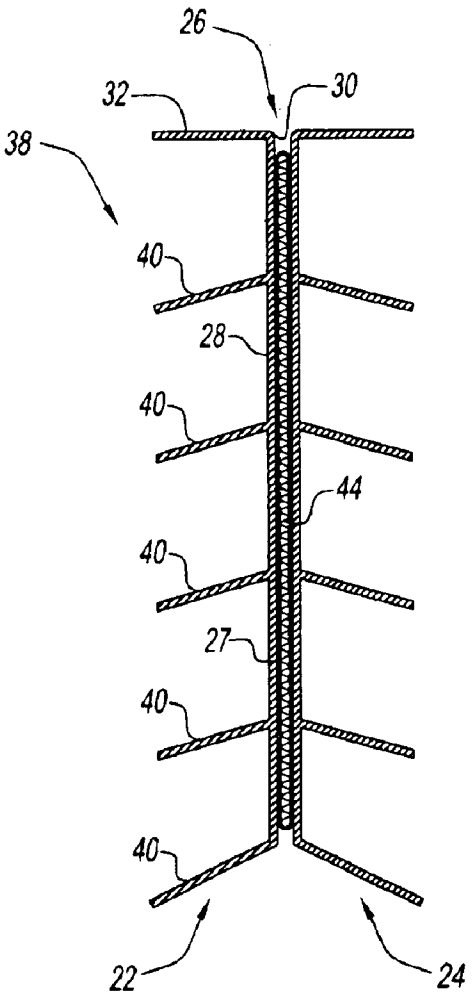
FIG. 6 is an enlarged cross-sectional view taken along line 6—6 of FIG. 2.
Figure 5:
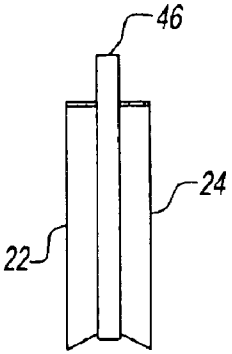
FIG. 5 is a side view of FIG. 1.
Figure 4:
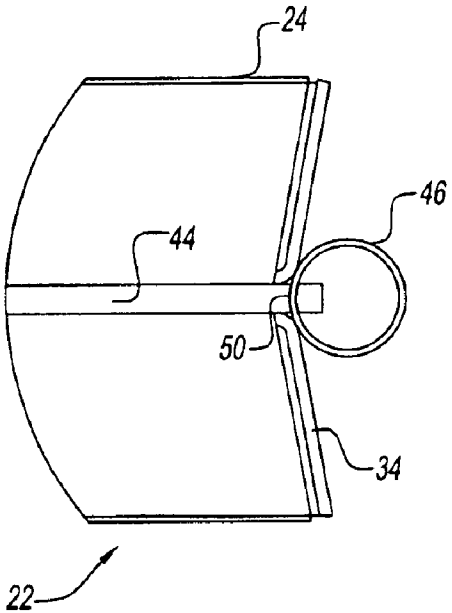
FIG. 4 is an enlarged view of detail B of FIG. 3.
Figure 7:
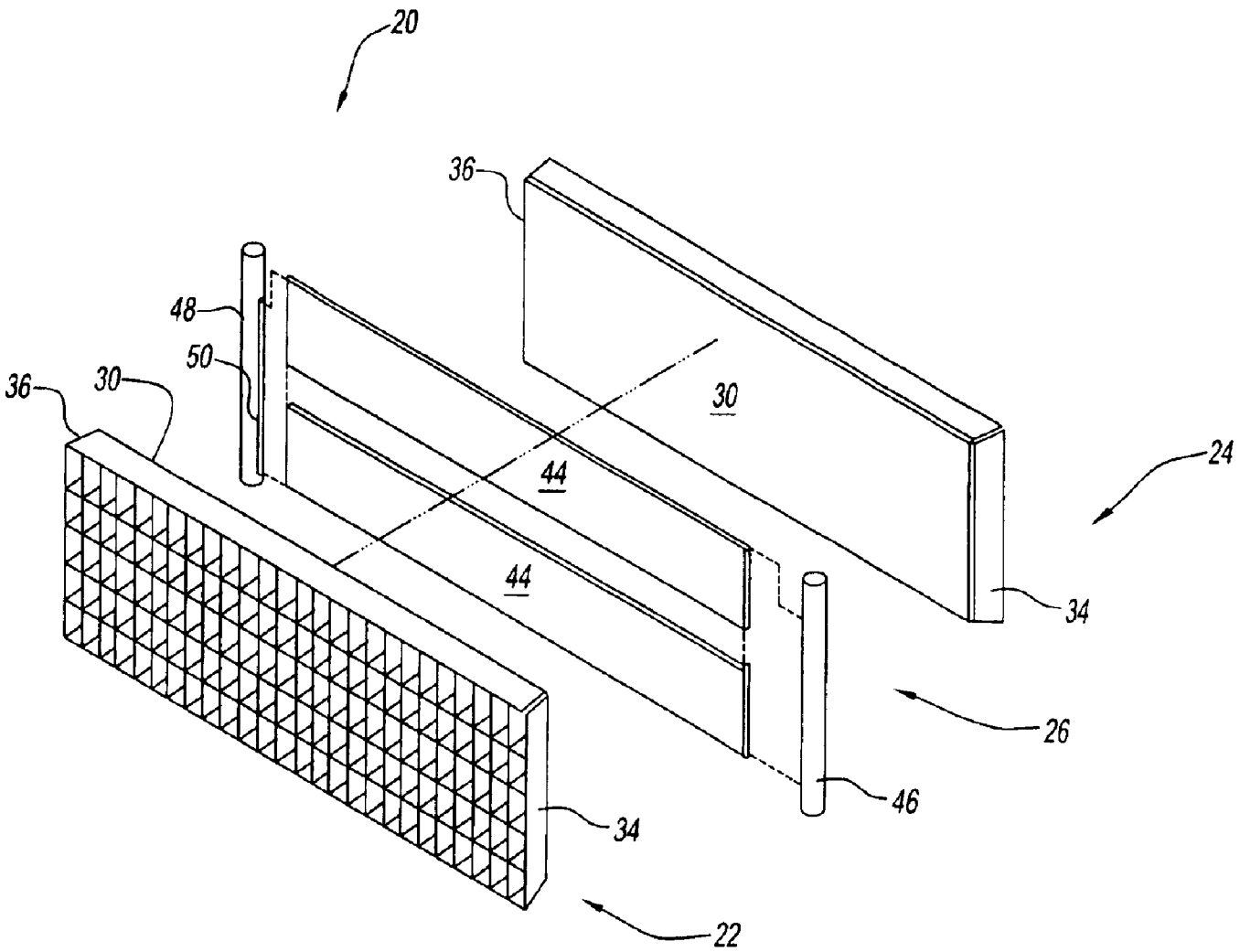
FIG. 7 is an exploded view of FIG. 1.

Referring to FIGS. 2–7, refrigerant conduit 26 includes a plurality of conduit sections 44 connected on opposed ends thereof to headers 46 and 48. Header 48 is shown in FIG. 7, as including a slot 50 in which one end of each conduit section 44 resides. Header 46 also includes a slot 50 (shown in FIGS. 3 and 4) in which the other ends of conduit sections 44 reside. Headers 46 and 48 are located adjacent to the external surfaces of sides 34 and 36 of each evaporator pan 22 and 24, respectively. This allows conduit sections 44 to be in direct mechanical contact with backs 30 of evaporator pans 22 and 24 so as to maximize thermal transfer and efficiency.

As shown in FIGS. 3, 4, 6 and 7, conduit sections 44 have a shape and size that provides a large surface area in thermal and mechanical contact with evaporator pans 22 and 24. Preferably, the cross-section of each conduit section 44 is non-circular. More preferably, the non-circular cross-section includes opposed wide area surfaces that cover substantial areas of bottoms 27 of evaporator pans 22 and 24. For example, the cross-section may be substantially rectangular with wide area surfaces that are parallel to the back 30 and/or front 28 of evaporator pans 22 and 24. This allows the gap between adjacent conduit sections 44 to be minimized so that the refrigerant flow covers a relatively large area of bottoms 27 of evaporator pans 22 and 24. This is to be contrasted with conduit assemblies that use conduit sections that have a circular cross-section that does not have any wide area surface that is parallel to the back and/or front of the evaporator pans.

The geometry and gap spacing of conduit sections 44 increase the thermal transfer efficiency, thereby providing many possibilities. For example, an ice machine employing evaporator assembly 20 can have a large ice capacity in a smaller space or have lower energy consumption or a combination thereof. The rest of the ice machine will change depending on which of these objectives is desired. The remaining components (e.g., compressor and condenser)

could be increased to obtain increased ice capacity or could be of the same size or smaller to obtain lower energy consumption.

As another example, to make 500 pounds of ice with a circular cross section refrigerant conduit design in a 24 hour period, an evaporator temperature of 0° F. is required. The temperature difference between the evaporator temperature of 0° F. and the water at 32° F. (freezing temperature) causes the water to change state and turn to ice. This requires a compressor of a certain size. To make the same 500 pounds of ice in a 24-hour period using the evaporator assembly of the present invention, it is projected that the evaporator temperature will need to be 18° F. A compressor's energy consumption is determined in large part by difference in pressure between the high side and low side. By making the evaporator pan warmer with the more thermal efficient evaporator assembly of the present invention, the pressure difference between the low and high side is decreased, thereby requiring less energy.

Figure 8:
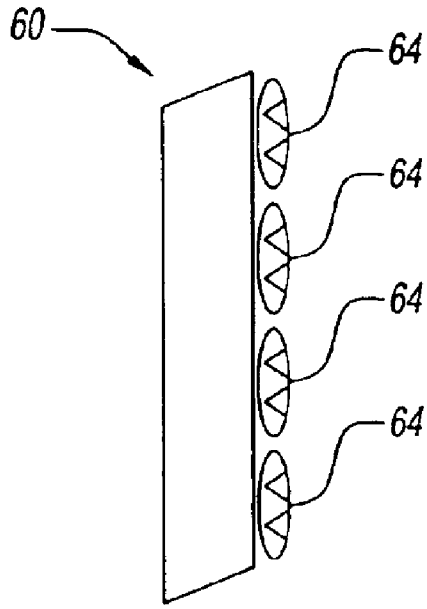
FIG. 8 is a side view of another embodiment of the assembly of a refrigerant conduit and evaporator pan of the present invention.
Figure 9:
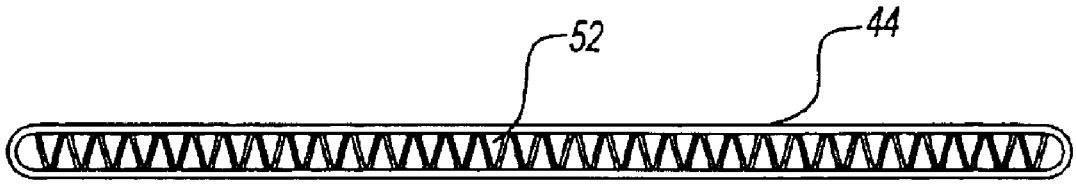
FIG. 9 is a cross-sectional view of another embodiment of the tube section that can be used in the evaporator assembly of the present invention.

Evaporator pans 22 and 24 and ice grids 38 are preferably constructed of stainless steel and conduit sections 44 and headers 48 are preferably constructed of aluminum. Conduit sections 44 are preferably aluminum extrusions. Each extrusion preferably includes internal channels 52 as shown in FIGS. 6, 8 and 9 for better strength and heat transfer from the extrusion walls. To provide a serpentine path for refrigerant flow, for example, one or more dividers (not shown) may be placed on one or both of headers 42 and 46. The refrigerant circuit of an ice machine then can be connected in fluid communication with the top of one the headers 46 and 48 and the bottom of the other header.

Although evaporator assembly 20 is shown with two conduit sections, it will be apparent to those skilled in the art that more than two conduit sections may be used. For example, FIG. 8 shows an evaporator assembly 60 that includes four conduit sections 64.

In addition, even though evaporator assembly 20 is shown with two evaporator pans, it is contemplated that evaporator assembly 20 may have only one evaporator pan. In a one evaporator pan assembly, additional structural stability, if desired, could be provided by any suitable fastening structure. For example, the structure could be placed on the opposite side of the conduit assembly and fastened by screws, bolts, soldering, brazing and the like to the evaporator pan and/or conduit assembly.

The method for making the evaporator assembly comprises the following steps:

1. Brazing material is applied to each of the surfaces to be bonded. This includes all surfaces where ice grid 38 touches the evaporator pan 22 or 24, where the extrusions enter the headers 46 and 48, and where the extrusions 44 and headers 46 and 48 touch the evaporator pans 22 and 24.
2. Placing the assembly of step 1 in a fixture that holds it together.
3. Placing the fixture and assembly in a brazing furnace so as to heat evaporator assembly 20 and braze ice grids 38, evaporator pans 22 and 24, conduits 44 and headers 46 and 48 together.

Figure 10:
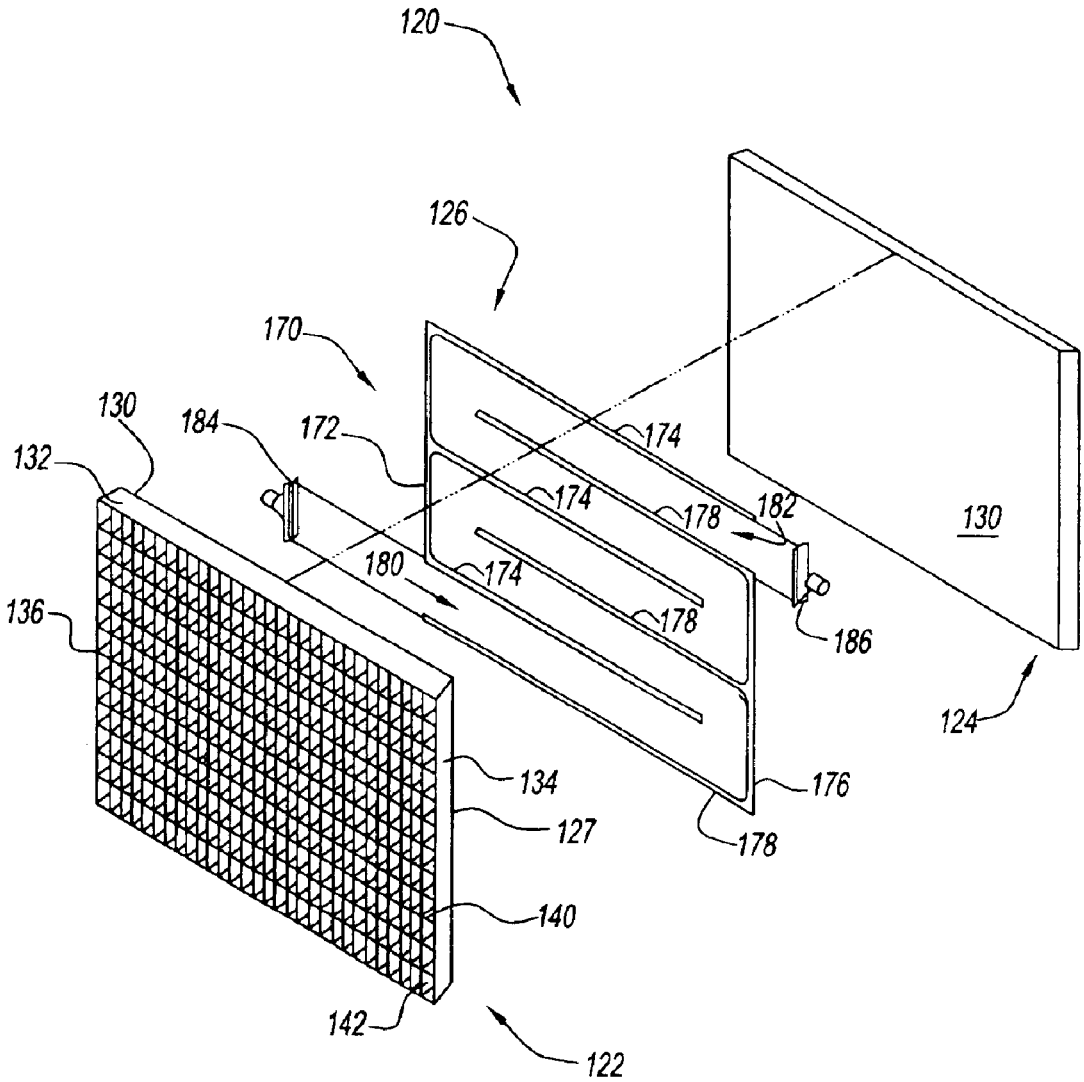
FIG. 10 is an exploded perspective view of an alternate embodiment of the present invention.

Referring to FIG. 10, an evaporator assembly 120 constitutes an alternate embodiment of the present invention. Evaporator assembly 120 includes a first evaporator pan 122, a second evaporator pan 124 and a refrigerant conduit assembly 126 disposed between evaporator pans 122 and 124.

Each of the evaporator pans 122 and 124 is substantially identical so that only evaporator pan 122 will be described in detail. Evaporator pan 122 includes a bottom 127, a top side 132 and opposed sides 134 and 136. Bottom 127 includes a front (obscured in FIG. 10) and a back 130. An ice cube structure shown as an ice grid 136 is disposed on the front and between opposed sides 134 and 136 of evaporator pan 122. Ice grid 138 has a plurality rows, each formed of a fin 140, and a plurality of columns, each formed of a divider 142.

Conduit assembly 126 includes a flow path boundary ridge structure 170 that is disposed between and in contact with evaporator pans 122 and 124 so as to define a flow path for refrigerant. Flow path boundary ridge 170 includes a first section 172 having tines 174 and a second section 176 having tines 178. Sections 172 and 176 are disposed so that tines 174 and 178 are interleaved to form a serpentine flow path. Preferably, the sections 172 and 176 are solid and of the same material as evaporator pans 122 and 124 and ice grid 136. Preferably, the material is stainless steel for pans 122 and 124 and sections 172 and 176 and copper for ice grid 136.

The refrigerant flow path is defined on two opposed sides by backs 130 of evaporator pans 122 and 124 and on all other sides by flow path boundary ridges 172 and 174. The flow path has first and second end openings 180 and 182, which are adapted to be capped by separate fittings 184 and 186 that are connected with a refrigeration circuit of an ice maker. The flow path comprises five refrigerant conduit sections that each has a substantially rectangular cross-section. Each refrigerant conduit section is bounded on two opposed sides by a tine 174 and a tine 178. The areas in-between the tine 174 and the tine 178 on backs 130 of evaporator pans 122 and 124 define the other two opposed sides of the refrigerant conduit section.

The geometry of flow path boundary ridges 172 and 174 and evaporator pans 122 and 124 is designed such that the resulting refrigerant flow cross-sectional area is equivalent to that of a common refrigeration tube diameter. This is preferably equivalent to a 0.5 inch diameter tube. This reduces the amount of pressure drop of the refrigerant as it flows through evaporator assembly 120 to equal the 0.5 inch copper tube design.

It is also desirable to make flow path boundary ridges 172 and 174 as thin as possible. This allows maximum refrigerant contact with evaporator pans 122 and 124 while minimizing the internal volume of evaporator assembly 120. Minimizing the internal volume of evaporator assembly 120 allows for reduced refrigerant cost and less refrigerant floodback to the compressor during the ice harvesting cycle.

Although evaporator assembly 120 is shown with two evaporator pans, it is contemplated that evaporator assembly 120 may have only one evaporator pan. In a one evaporator pan assembly, the refrigerant conduit assembly could be sandwiched between the evaporator pan and a body that has at least one flat surface to complete the conduit assembly.

Figure 11:
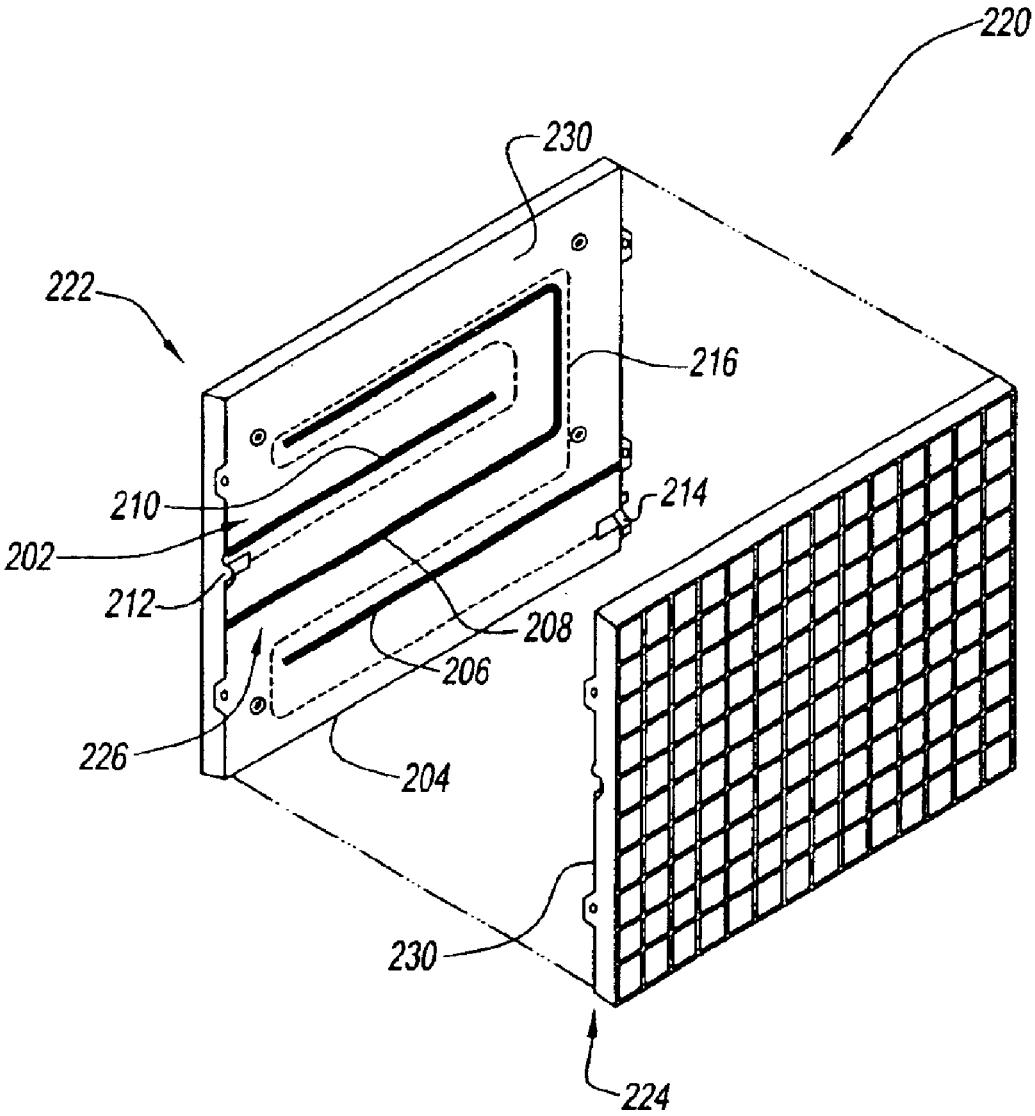
FIG. 11 is an exploded perspective view of another alternate embodiment of the present invention.

Referring to FIG. 11, evaporator assembly 220 constitutes another alternate embodiment of the present invention. Evaporator assembly 220 includes a first evaporator pan 222, a second evaporator pan 224 and a refrigerant conduit assembly 226. Evaporator pans 222 and 224 each have a back 230 that differs slightly from backs 130 of evaporator pans 122 and 124, but otherwise are similar.

Refrigerant conduit 226 is similar to refrigerant conduit assembly 126, differing therefrom in manner of construction and serpentine arrangement. As to construction, a pattern of boundary ridges 202 is disposed on back 230 of evaporator pan 222 and a mating pattern of ridges (not shown) is disposed on back 230 of evaporator pan 224. Ridge pattern 202 includes a perimeter ridge 204, and interior ridges 206, 208 and 210 that extend inwardly from perimeter ridge 204. Ridges 206 and 210 are straight and ridge 208 forms a U-shape with ridge 210 being disposed in the U. A pair of refrigerant fittings 212 and 214 is disposed in perimeter ridge 204 at locations to provide a serpentine refrigerant flow along the dashed line 216.

When evaporator plates 222 and 224 are fastened together in back to back fashion the mating ridge patterns mate with one another and form a serpentine flow path along line 216 between fittings 212 and 214. Refrigerant in the flow path is in direct contact with each evaporator pan 222 and 224, thereby providing an increased thermal transfer and efficiency. Alternatively, the mating ridge pattern on back 130 of evaporator pan 224 may be omitted and the ridges 204, 206, 208 and 210 made high enough to engage back 230 of evaporator plate 224.

Refrigerant conduit 226 has a number of conduit sections that each has a substantially rectangular cross-section. For example, one conduit section has a pair of opposed sides bounded by ridges 206 and 208. The areas between ridges 206 and 208 on backs 230 of evaporator pans 222 and 224 define the other pair of opposed sides of the refrigerant conduit.

The exposed surfaces of evaporator assembly 220 are treated with a coating that prevents corrosion. Evaporator pans 222 and 224 are preferably aluminum or aluminum alloy.

Evaporator assembly 220 is made by brazing the two aluminum die cast ice forming molds 222 and 224 together in a furnace. Die castings 222 and 224 are cast with a ridge geometry that when brazed together results in a defined refrigerant flow path.

Evaporator assembly 220 has the following advantages:

1. Enhanced heat transfer. In traditional evaporators, a copper tube carrying refrigerant is bonded to the back of the ice making surface. In evaporator assembly 220, rather than heat passing through the part of the surface of a tube in contact with the pan, the entire back surface of the aluminum casting is exposed to the refrigerant.
2. Enhanced heat transfer by virtue of having two ice making surfaces instead of one associated with one refrigerant flow path.
3. Reduced part count. There are only two aluminum die castings vis-a-vis the traditional design, which has a tube, pan and a multitude of strips for the ice grid.
4. Lighter weight. (Aluminum vs. copper).
5. Easier to manufacture.

Although evaporator assembly 220 is shown with two evaporator pans, it is contemplated that evaporator assembly 220 may have only one evaporator pan. In a one evaporator pan assembly, the refrigerant conduit assembly could be sandwiched between the evaporator pan and a body that has at least one flat surface to complete the conduit assembly, with the ridges being disposed on either or both of the evaporator pan and the flat sheet surface.

The present invention having been thus described with particular reference to the preferred forms thereof, it will be obvious that various changes and modifications may be made therein without departing from the spirit and scope of the present invention as defined in the appended claims.

What is claimed is:

1. An evaporator assembly comprising:

at least one evaporator pan including a first side with a structure that facilitates formation of ice cubes and a second side;

a refrigerant conduit that is disposed in thermal contact with said second side of said evaporator pan and that comprises one or more sections; and a ridge structure that defines said refrigerant conduit sections, wherein said ridge structure comprises a plurality of ridges disposed in contact with said second side of said evaporator pan, wherein at least two of said ridges are spaced from and parallel to one another, wherein said ridges form opposed sides of at least one of said sections, and wherein an area between said ridges comprises another side of said one section.

2. The evaporator assembly of claim 1, wherein a refrigerant flow through said sections covers substantially all of said second side of said evaporator pan.

3. The evaporator assembly of claim 1, wherein one or more of said refrigerant conduit sections have a non-circular cross-section.

4. The evaporator assembly of claim 3, wherein said cross-section is rectangular.

5. The evaporator assembly of claim 3, wherein said non-circular cross-section has a side that is substantially flat and that is substantially parallel to said first side.

6. The evaporator assembly of claim 1, wherein at least one of said ridges is shared with an adjacent section.

7. The evaporator assembly of claim 1, further comprising first and second fittings, and wherein said first and second fittings and said ridges are arranged to provide a serpentine pattern.

8. The evaporator assembly of claim 1, further comprising an additional evaporator pan having a first side with a structure that facilitates formation of ice cubes and a second side, and wherein said refrigerant conduit is also in thermal contact with said second side of said additional evaporator pan.

9. The evaporator assembly of claim 8, wherein one or more of said refrigerant conduit sections have a rectangular cross-section.

10. The evaporator assembly of claim 8, wherein a refrigerant flow through said sections covers substantially all of the respective second sides of said evaporator pan and said additional evaporator pan.

11. The evaporator assembly of claim 8, wherein said sections have opposed sides that are substantially flat and substantially parallel to said first sides of said evaporator pan and said additional evaporator pan.

12. The evaporator assembly of claim 1, wherein said sections are sized such that refrigerant flow through said sections covers a percentage of said second side of said evaporator pan that is in a range of about 30% to 100%.

13. The evaporator assembly of claim 1, wherein said ridges are integral with said second side.

14. The evaporator assembly of claim 12, wherein said percentage is in the range of about 40% to 100%.

15. The evaporator assembly of claim 12, wherein said percentage is in the range of about 80% to 100%.

16. A method for making an evaporator assembly comprising:

forming an ice cube structure on a first side of at least one evaporator pan; and forming a refrigerant conduit on a second side of said evaporator pan, wherein said refrigerant conduit comprises a ridge structure that defines one or more sections that have a substantially rectangular cross-section.

17. The method of claim 16, wherein said refrigerant conduit further comprises first and second fittings that are connected to said ridge structure so as to form a serpentine refrigerant flow path.

18. The method of claim 16, wherein said ridge structure is formed on said second side of said evaporator pan by a bonding process.

19. The method of claim 18, wherein said bonding process uses a brazing material.

20. The method of claim 18, wherein said ridge structure is disposed between said second side of said evaporator pan and a body that includes a substantially flat surface that is substantially parallel to said second side of said evaporator pan, and wherein said bonding process bonds said ridge structure to said flat surface.

21. The method of claim 16, wherein said ridge structure is formed on said second side of said evaporator pan by a die cast process.

22. The method of claim 21, wherein said ridge structure is closed by an adjacent body that is shaped to give each of said sections a substantially rectangular cross-section.

23. The method claim 22, further comprising a plurality of said ridge structures, wherein said body comprises a mating ridge structure on a surface thereof, and wherein said ridge structures are fastened together in a mating way to form said sections.

24. The method of claim 16, further comprising fastening said refrigerant conduit to a second side of an additional evaporator pan.

25. The method of claim 16, wherein a refrigerant flow through said sections covers substantially all of said second sides of said evaporator pan and said additional evaporator pan.

26. The method of claim 16, wherein said sections are sized such that refrigerant flow through said sections covers a percentage of said second sides of said evaporator pan and of said additional evaporator pan, said percentage being in a range selected from the group consisting of about 30% to 100%.

27. The method of claim 26, wherein said percentage is in a range of about 40% to 100%.

28. The method of claim 26, wherein said percentage is in a range of about 80% to 100%.

29. The method of claim 16, wherein said sections are sized such that refrigerant flow through said sections covers a percentage of said second side of said evaporator pan that is in a range of about 30% to 100%.

30. The method of claim 29, wherein said percentage is in a range of about 40% to 100%.

31. The method of claim 29, wherein said percentage is in a range of about 80% to 100%.

* * * * *